US006864441B2

(12) United States Patent
Qiu

(10) Patent No.: US 6,864,441 B2
(45) Date of Patent: Mar. 8, 2005

(54) ROTATING ELECTRIC SWITCH

(75) Inventor: Zhiming Qiu, Ningbo (CN)

(73) Assignee: Ningbo Beifa Group Co., Ltd., Ningbo (CN)

( * ) Notice: Subject to any disclaimer, the term of this patent is extended or adjusted under 35 U.S.C. 154(b) by 0 days.

(21) Appl. No.: 10/746,139

(22) Filed: Dec. 26, 2003

(65) Prior Publication Data

US 2004/0154906 A1 Aug. 12, 2004

(30) Foreign Application Priority Data

Dec. 26, 2002 (CN) ..... 02 1 60326.X

(51) Int. Cl.[7] ..... H01H 9/30
(52) U.S. Cl. ..... 200/11 R; 200/564; 200/336
(58) Field of Search ..... 200/11 R–11 TC, 200/564, 570, 336

(56) References Cited

U.S. PATENT DOCUMENTS 4,603,238 A * 7/1986 Griswold et al. ..... 200/11 R
5,070,078 A * 12/1991 Selway et al. ..... 514/50
5,438,172 A * 8/1995 Fowler et al. ..... 200/11 R
5,746,380 A * 5/1998 Chung ..... 242/171
5,967,304 A * 10/1999 MacKay et al. ..... 200/565
6,097,299 A * 8/2000 Yamamura ..... 340/686.3

* cited by examiner

*Primary Examiner*—Kyung S. Lee
(74) *Attorney, Agent, or Firm*—Christensen O'Connor Johnson Kindness PLLC

(57) ABSTRACT

A rotating electric switch includes a shaft with a side hole and a biasing member in the side hole for outwardly biasing an electrically-conductive bullet. The bullet is in electrical communication with a shaft conductor in a bottom hole of the shaft. A liner insulation cap placed over the shaft has a hole in the liner insulation cap sidewall covered by an electrically conductive sleeve. The switch achieves a non-conducting state by rotating the shaft until the head of the bullet is retracted within the sidewall of the liner insulation cap. A conducting state is achieved by rotating the shaft until the bullet extends through the hole in the liner insulation cap sidewall to electrically contact the conductive sleeve. Further embodiments may include an electrically-conductive inner tube in the side hole of the shaft and one or more grooves defined in the interior surface of the liner insulation cap.

20 Claims, 3 Drawing Sheets

ROTATING ELECTRIC SWITCH

FIELD OF THE INVENTION

This invention relates to electric switches, and more particularly to a rotating electric switch that may be used in everyday articles having a power source.

BACKGROUND OF THE INVENTION

Many everyday articles having a battery or other equipment supplying an electric charge, such as a pen lamp with illuminator, various motor driven or power controlled toys, and many operating tools, instruments and meters, need an electric switch that has simple structure, dependable function, and low cost. In the past, sliding electric switches have frequently been adopted, but such switches may fail to operate after a short time of use due to unreliable functionality. Pushing electric switches have also been used, but they often fail to work due to loose contacting. Rotating electric switches are known, but in the past, the structure and function of these switches have been unstable and unreliable. One kind of pushing switch for pen lamps disclosed in Chinese Patent No. 94210853 can be easily handled with a single hand, but its structure was very complicated and required a complex assembly process. A type of knob switch for a pen-shaped flashlight is disclosed in Chinese Patent No. 91223503, but also suffers from shortcomings, such as a less reasonable structure, less convenience for operating, and unreliable functionality.

SUMMARY OF THE INVENTION

The present invention provides a rotating electric switch having many advantages such as a simple structure, nimble turning, comfortable feel, convenient operation, more stable and reliable function, and ease of manufacture.

Embodiments of the present invention achieve the aforesaid advantages by providing a new and improved rotating electric switch structure. An embodiment of the invention provided herein for illustration is comprised of parts, including a shaft 13, an inner tube 12, a spring 15, a bullet 16, a liner insulation cap 14, a conductive sleeve 19, a conductive spring 21, a conductive post 20, and an electric conductor 18. The shaft 13 and the liner insulation cap 14 are made of an insulating material, such as plastic, while the inner tube 12, spring 15, bullet 16, sleeve 19, conductive post 20, and electric conductor 18 are preferably made of metal having a high electric conductivity.

In one embodiment, a rotating electric switch is assembled by providing a shaft with a side hole and inserting a biasing member, such as a spring, into the side hole. A bullet having a base and a head is then inserted into the side hole of the shaft such that the base of the bullet bears against the biasing member. The biasing member biases the bullet outward so that the head of the bullet is exposed outside of the shaft. A bottom hole defined in bottom of the shaft receives a shaft conductor that, when inserted into the bottom hole, is placed in electrical communication with the bullet. The shaft conductor may comprise a conductive spring and/or a conductive post, or an electrical conductor in the form of a spring.

A liner insulation cap formed of an insulating material is placed over the shaft and bullet such that the shaft and bullet can rotate within the liner insulation cap. The liner insulation cap has a sidewall with a hole extending through the sidewall. An electrically conductive sleeve is placed over the hole in the cap sidewall.

When assembled, this embodiment of the switch is placed in a non-conducting state by rotating the shaft until the head of the bullet is retracted within the sidewall of the liner insulation cap. The switch is placed in a conducting state by rotating the shaft until the bullet is positioned over the hole in the liner insulation cap sidewall, thereby permitting the head of the bullet to extend outward through the hole and electrically contact the conductive sleeve.

In further embodiments of the invention, an electrically conductive inner tube may be inserted into the side hole of the shaft and the biasing member, such as a spring, is inserted into the inner tube. Furthermore, one or more grooves may be defined in the interior surface of the liner insulation cap sidewall at positions rotationally offset from the hole in the cap sidewall. When the bullet is positioned over a groove, the biasing member and groove preferably cooperate to provide a detent force that retains the head of the bullet in the groove and holds the switch in a non-conducting state. Similarly, when the bullet is positioned over the hole in the cap sidewall, the hole and the biasing member preferably cooperate to provide a detent force that retains the head of the bullet in the hole and holds the switch in a conducting state.

In yet further embodiments of the invention, multiple holes may be defined in the shaft sidewall, with each hole having a bullet that is biased outward by the biasing member. Likewise, multiple holes may be defined in the sidewall of the liner insulation cap to permit one or more bullets in the shaft to come into electrical contact with the conductive sleeve on the outside of the liner insulation cap. The one or more grooves and one or more holes in the liner insulation cap sidewall may be configured of similar size and shape.

Compared with existing switch technologies, embodiments of the present invention achieve the advantages of having simple structure, nimble operation, comfortable feeling and easy installation, and can be used in a wide variety of devices, such as a pen lamp with illuminator, various motor driven or power controlled toys, or in operating tools, instruments, and meters, etc.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The following description provides an overview and detailed description of one example of a rotating electric switch constructed in accordance with the present invention. Also provided is an applied example for implementing an embodiment of the invention in a pen. While illustrative examples are described herein and parts for assembling embodiments of the invention are shown, these specific examples and parts are not intended to be exhaustive or to limit the invention to the precise forms disclosed. Moreover, the particular number, shape, and size of parts described herein are not limiting to the invention, as parts may be combined or divided out in manufacturing (thus reducing or increasing the number of parts). The shape or size of parts may also be modified or parts may be eliminated or added without departing from the scope of the invention as defined by the claims. Such alternative designs can be assembled and achieve the benefits and advantages of the present invention.

Figure 1:
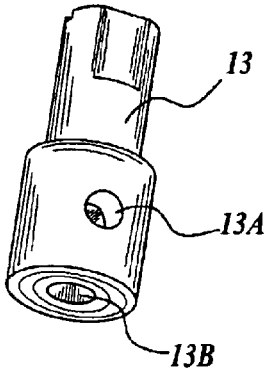
FIG. 1 is lower perspective view of a shaft for use in an embodiment of the present invention.

Structure and Assembly of a Preferred Embodiment:

FIGS. 1–14 illustrate a structure and assembly of one exemplary embodiment of a rotating electric switch constructed in accordance with the present invention. Turning first to FIG. 1, this embodiment of a rotating electric switch begins with a shaft 13. The shaft 13 is generally cylindrical in shape and has one or more holes 13A defined laterally in its sidewall. In a currently preferred embodiment, two holes 13A are defined in opposite sides of the sidewall by defining a hole that extends laterally through a cross-section of the shaft 13. Defined in the bottom of the shaft 13 is a hole 13B. The bottom hole 13B extends vertically into the shaft 13 in the same direction as the principal rotational axis of the cylindrical shaft 13. The side hole 13A and the bottom hole 13B are interlinked in the shaft 13. For example, the bottom hole 13B may be a straight blind hole that extends into the side hole 13A. Alternatively, the side hole 13A and bottom hole 13B may be interlinked by an electrical connection, such as a wire extending between the bottom hole 13B and the side hole 13A. The shaft 13 is formed of an insulating material, preferably plastic for ease of manufacture.

Figure 2:
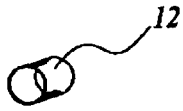
FIG. 2 is a perspective view of an inner tube configured for lateral insertion into the shaft shown in FIG. 1.
Figure 3:
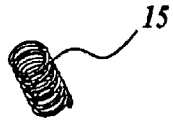
FIG. 3 is a perspective view of a spring configured for insertion into the tube shown in FIG. 2.

FIG. 2 illustrates an optional inner tube 12, typically formed of a thin-wall tube, that is configured for insertion into the side hole 13A of the shaft 13. The inner tube 12 is preferably matched in size with the inner surface of the side hole 13A, though the length of the tube 12 may be adjusted as needed. After the tube 12 has been placed inside the hole 13A, a biasing member is inserted into the hole 13A and into the tube 12. The biasing member may be a spring 15 as shown in FIG. 3. The diameter and length of the spring 15 are sized to fit inside the tube 12. When assembled, the spring 15 is positioned toward the center of the tube 12. If the shaft has only a single side hole 13A, the biasing member (ie., spring 15) may be positioned at the bottom of the hole 13A (or the bottom of the tube 12 in the hole 13A).

Figure 4:
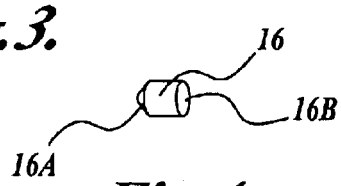
FIG. 4 is a perspective view of a bullet configured for insertion into an end of the tube shown in FIG. 2.
Figure 13:
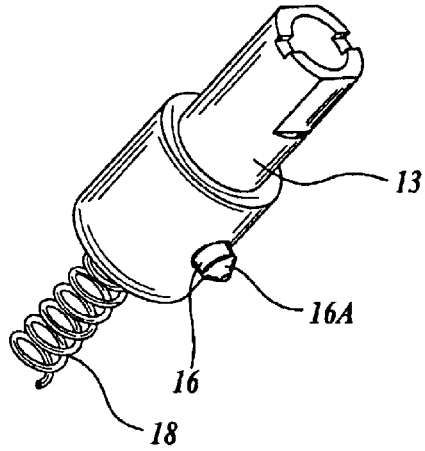
FIG. 13 is a perspective view of the shaft shown in FIG. 1 with the inner tube, springs, bullets, conductive post and electric conductor of FIGS. 2–11 in an assembled condition.

FIG. 4 depicts a bullet 16 that is formed having a generally cylindrical shape and a flat base 16B at one end. The other end of the bullet is shaped with a circular cone leading to a pointed head 16A. Other embodiments of the bullet 16 may be shaped differently, for example, with a spherical, triangular, or pyramid-shaped end leading to the pointed head 16A. The pointed head 16A can be shaped, if desired, with a rounded spherical tip. For assembly, the bullet 16 is inserted into the tube 12 such that the base 16B bears against the spring 15 positioned within the inner tube 12. In a currently preferred embodiment where two holes 13A are defined in opposite sides of the shaft sidewall, two bullets 16 are placed within the tube 12, one in each hole 13A, each having its base 16B bear against the spring 15. The spring 15 thus biases the bullets 16 outward so that the pointed head 16A of each of the bullets is exposed outside of the side holes 13A, as shown in FIG. 13. As with the tube 12 and spring 15, the bullets 16 are formed of electrically conductive material, such as metal.

Figure 5:
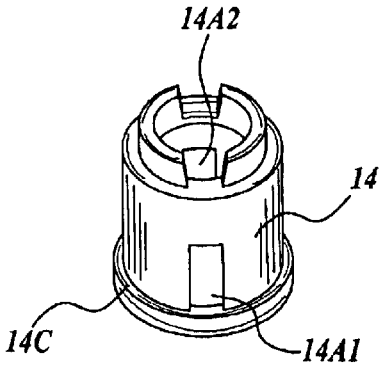
FIG. 5 is an upper perspective view of a liner insulation cap configured for placement over the shaft shown in FIG. 1.
Figure 6:
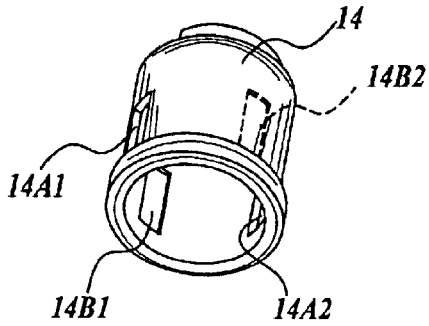
FIG. 6 is a lower perspective view of the liner insulation cap shown in FIG. 5.
Figure 7:
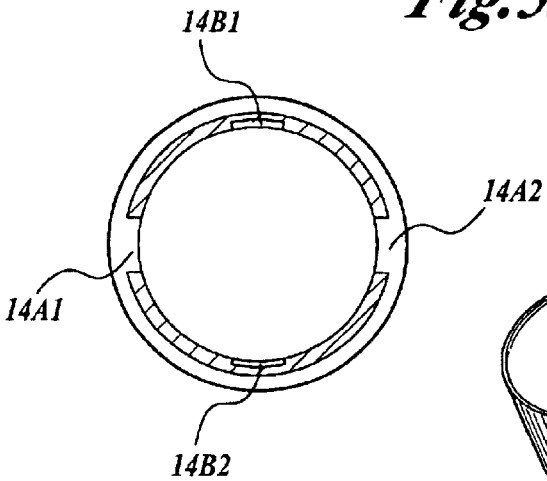
FIG. 7 is an enlarged sectional view of the liner insulation cap shown in FIGS. 5 and 6.

Turning next to FIGS. 5–7, a liner insulation cap 14 is provided for placement over the shaft 13. The liner insulation cap 14 is generally tubular in shape and has an inner diameter that is slightly larger than the diameter of the shaft 13 so the shaft 13 can fit and rotate within the cap 14. Where the shaft 13 is configured as illustrated in FIG. 1 with a lower shaft portion having a diameter larger than an upper shaft portion, the liner insulation cap 14 may likewise be comprised of lower and upper portions having different diameters that follow the diameters of the shaft 13.

Figure 14:
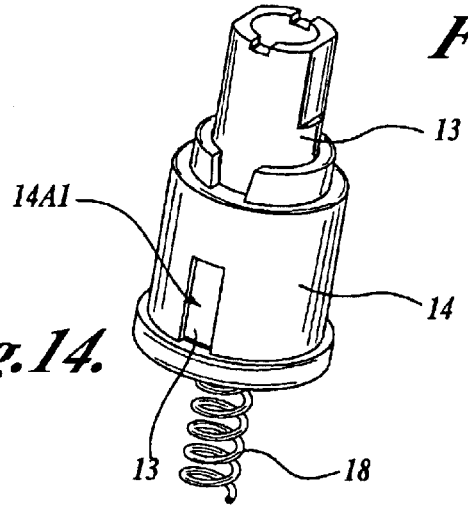
FIG. 14 is an upper perspective view of the liner insulation cap of FIG. 5 placed over the assembly shown in FIG. 13.

In terms of assembly, the liner insulation cap 14 is placed over the shaft 13 such that the upper portion of the shaft 13 extends through the upper portion of the liner insulation cap 14 as shown in FIG. 14. In this particular embodiment, a shelf in the liner insulation cap 14 that divides the upper and lower portions of the cap 14 rests against a corresponding shelf in the shaft 13 that divides the upper and lower portions of the shaft 13.

Further defined in the liner insulation cap 14 are one or more holes 14A1, 14A2 and one or more grooves 14B1, 14B2. The holes 14A1 and 14A2 extend through the sidewall of the liner insulation cap 14 and, in this embodiment, are defined on opposite sides of the liner insulation cap 14 symmetrical to the center axis line of the cylindrical cap 14. The holes 14A1, 14A2 are depicted rectangular in shape, but other shaped holes may be used. The holes 14A1, 14A2 are sized to allow the pointed head 16A of a bullet 16 to extend outside the sidewall of the liner insulation cap 14 when the cap 14 is installed on the shaft 13 and the bullet 16 lines up with a hole 14A1, 14A2.

The one or more grooves 14B1, 14B2 are defined vertically in the interior surface of the sidewall of the liner insulation cap. The grooves 14B1 and 14B2 may have a size and shape similar to the holes 14A1, 14A2, but such is not required. The grooves 14B1, 14B2 are "vertically-defined" in that they do not extend horizontally around the entire interior circumference of the liner insulation cap 14.

In a currently preferred embodiment of the rotating electric switch as shown, the grooves 14B1 and 14B2 are defined symmetrical to the center axis line of the liner insulation cap 14 at opposite sides of the sidewall approximately half way between the location of the holes 14A1, 14A2. In the embodiment shown, the grooves 14B1, 14B2 are located approximately 90 degrees from the holes 14A1, 14A2. The principal difference between the side holes 14A1, 14A2 and the grooves 14B1, 14B2 is that the former (the side holes) extend through the sidewall of the liner insulation cap 14 and the latter are grooves that do not extend through the sidewall. The depth of the grooves may be any portion of the cap sidewall, for example half the thickness of the sidewall. The liner insulation cap 14 is formed of an insulating material, such as plastic.

Figure 8:
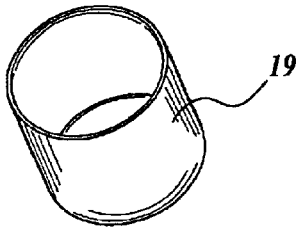
FIG. 8 is a perspective view of a conductive sleeve configured to fit over the liner insulation cap shown in FIG. 5.
Figure 12:
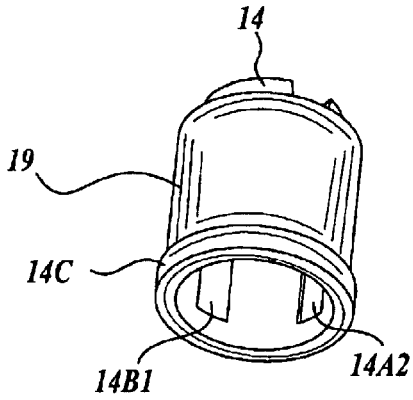
FIG. 12 is a lower perspective view of the liner insulation cap shown in FIG. 6 with the conductive sleeve of FIG. 8 fitted thereon.

FIG. 8 illustrates a tubular conductive sleeve 19 having an inner diameter that is slightly larger than the outer diameter of the lower portion of the liner insulation cap 14. In the illustrated embodiment, the conductive sleeve 19 is placed over the liner insulation cap 14 and surrounds the outside surface of at least the lower portion of the cap 14, as shown in FIG. 12. In other embodiments, the conductive sleeve 19 may be configured to cover only the holes 14A1, 14A2. As the name of the sleeve 19 suggests, the conductive sleeve 19 is formed of an electrically conductive material, such as metal.

Figure 9:
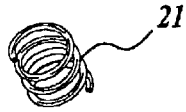
FIG. 9 is a perspective view of a conductive spring configured for axial insertion into the bottom hole of the shaft shown in FIG. 1.
Figure 10:
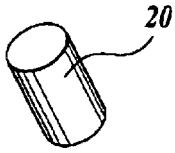
FIG. 10 is a perspective view of a conductive post configured for axial insertion into the bottom hole of the shaft shown in FIG. 1.
Figure 16:
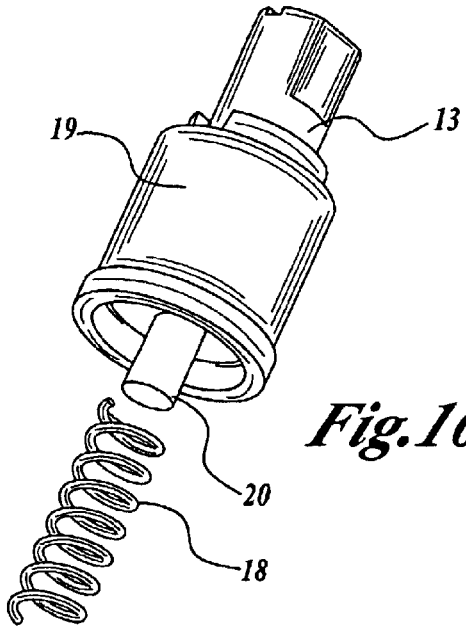
FIG. 16 is a lower perspective view of the assembly shown in FIG. 15, further illustrating the electric conductor to be fitted on the conductive post in the shaft.

FIGS. 9 and 10 illustrate a shaft conductor comprised of a conductive spring 21 and a conductive post 20, respectively, that are configured for insertion into the vertically-defined hole 13B in the shaft 13. Specifically, in this embodiment, the conductive spring 21 is inserted first into the hole 13B and rests against the inner tube 12 (FIG. 2) that previously has been laterally inserted into the side hole 13A of the shaft 13. The conductive post 20 is next inserted into the vertical hole 13B in contact with the spring 21. The spring 21, in this embodiment of the invention, is used to ensure a good electrical connection between the inner tube 12 and the conductive post 20. Other embodiments of the invention may exclude the conductive spring 21 and/or the inner tube 12, provided the shaft conductor (here, conductive post 20) has a good electrical connection with the bullets 16. The conductive post 20 is preferably sized for fitting within the hole 13B such that frictional forces between the side of the hole 13B and the surface of the conductive post 20 act to retain the conductive post 20 within the hole 13B. The conductive post 20 is also preferably sized in length such that an end of the connective post 20 protrudes from the bottom of the shaft 13 (e.g., as illustrated in FIG. 16).

Figure 11:
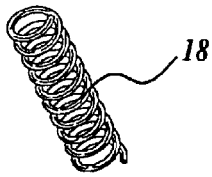
FIG. 11 is a perspective view of an electric conductor in the form of a spring configured to fit on the conductive post shown in FIG. 10.

Fitted onto the exposed end of the conductive post 20 is an optional electric conductor 18, shown separately in FIG. 11. The electric conductor 18 in this embodiment is configured in the form of a spring, though electric conductors of other shapes may be used in the invention. In FIG. 11, the electric conductor 18 is shown with a constant inner diameter through the length of the spring, though other embodiments may vary the inner diameter of the spring. For example, in a currently preferred embodiment, the inner diameter of the electric conductor 18 increases slightly as the spring 18 extends away from the conductive post 20. Use of an electric conductor 18 in the form of a spring may be helpful in making good electrical contact with a power source, such as a battery, as shown in an implementation of the invention in FIG. 17.

FIG. 13 depicts a partially assembled rotating electric switch constructed in accordance with the present invention. Not visible in FIG. 13 but inside the shaft 13 are the inner tube 12 and spring 15, both of which have been inserted into the side hole 13A of the shaft 13. A bullet 16 visibly protrudes from the side hole and bears against the spring 15 inside the shaft 13. Another bullet 16 protrudes from a side hole 13A on the opposite side of the shaft 13, which cannot be seen in this drawing. The bullet on the opposite side of the shaft 13 bears against the other end of the spring 15, an example of which can be seen in the implementation of the rotating electric switch shown in FIG. 17.

FIG. 14 depicts the assembly of FIG. 13 with a liner insulation cap 14 placed over the shaft 13. In this drawing, a hole 14A1 is shown in the liner insulation cap 14 exposing a small portion of the sidewall of the shaft 13. As noted earlier, the shaft 13 is designed to rotate within the liner insulation cap 14.

Figure 15:
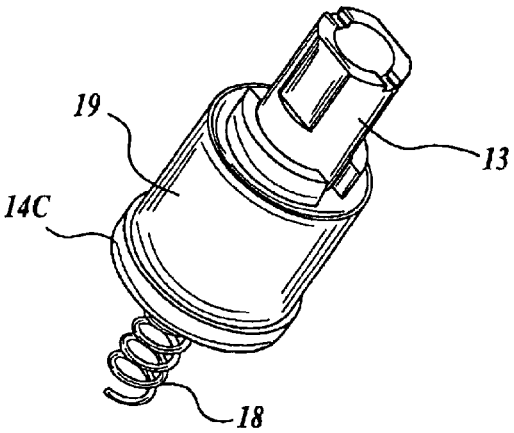
FIG. 15 is an upper perspective view of the assembly shown in FIG. 14 with the conductive sleeve shown in FIG. 8 placed thereon.

FIG. 15 illustrates the assembly of FIG. 14 with the conductive sleeve 19 (FIG. 8) placed over the liner insulation cap 14 and surrounding the cap 14. The conductive sleeve 19 rests against a bottom flange 14C of the liner insulation cap 14. The inner diameter of the conductive sleeve 19 may be sized for an interference fit with the outer surface of the liner insulation cap 14, if desired.

FIG. 16 illustrates the completed assembly of FIG. 15 from a lower angle that shows the insertion of the conductive post 20 in the shaft 13. FIG. 16 also illustrates the electric conductor 18 to be fitted onto the conductive post 20.

Operation of the Preferred Embodiment:

As noted earlier, the shaft 13, and all of the parts assembled inside the shaft (including the inner tube 12, spring 15, bullets 16, conductive spring 21, and conductive post 20) are configured to rotate within the liner insulation cap 14. The bullets 16 are biased outward by the spring 15 within the inner tube 12. Thus, when turning the shaft 13, the pointed heads 16A of the bullets 16 bear against the interior surface of the liner insulation cap 14. As the shaft 13 is rotated, the pointed heads 16A may come to rest within the grooves 14B1 (shown in FIG. 12) and 14B2 (shown in FIGS. 6 and 7). The grooves 14B1 and 14B2 provide a resting position for the shaft 13 when the rotating electric switch is in an open (i.e., non-conducting) state. Preferably, the spring 15 and the grooves 14B1, 14B2 cooperate to provide a detent force that helps retain the heads 16A of the bullets in the grooves and holds the switch in a non-conducting state. Furthermore, when the pointed heads 16A of the bullets 16 drop into the grooves 14B1 and 14B2, a clicking sound is preferably generated, indicating to the user that the rotating electric switch has come to rest in a non-conducting position.

Figure 17:
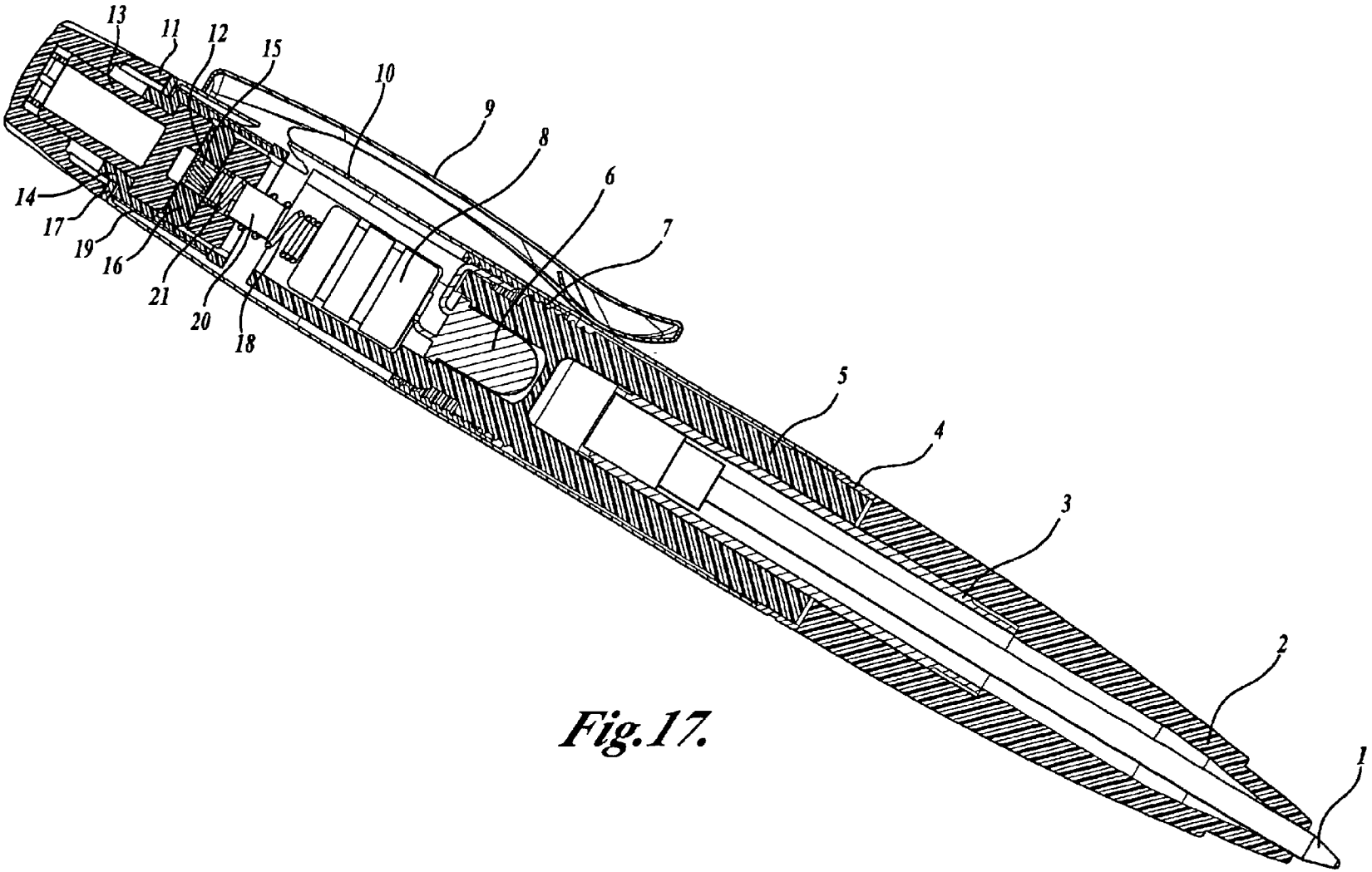
FIG. 17 is a sectional view of a pen having a rotating electric switch constructed in accordance with the present invention for operating a lamp within the pen.

Continuing to rotate the shaft 13, the pointed heads 16A of the bullets 16 eventually line up with the holes 14A1 (shown in FIGS. 6 and 7) and 14A2 (shown in FIG. 12). When the bullets 16 are lined up with the holes 14A1 and 14A2, the pointed heads 16A are biased outward by the spring 15 and come into electrical contact with the conductive sleeve 19 on the outside of the liner insulation cap 14. In this position, the rotating electric switch is in a closed (i.e., conducting) state. In other words, when the rotating electric switch is implemented (e.g., as shown in FIG. 17), electrical energy can be conducted through the rotating electric switch. Electrical energy in this embodiment travels from an energy source through the electrical conductor 18 to the conductive post 20 and conductive spring 21, and further to the electrically-conductive tube 12, spring 15, and bullets 16. The bullets 16 in contact with the conductive sleeve 19 enables the circuit to be completed back to the energy source. When the shaft 13 is further rotated, the bullets 16 retract within the liner insulation cap 14 and the circuit is broken.

As with the grooves 14B1 and 14B2, rotation of the shaft 13 preferably causes a clicking sound when the bullets 16 drop into the holes 14A1 and 14A2, thus audibly indicating to a user that the switch has entered into the closed (i.e., conducting) state. The holes 14A1, 14A2 and the spring 15 also preferably cooperate to provide a detent force that retains the bullets in the holes and holds the switch in the conducting state. Due to the spacing of the holes 14A1, 14A2 and grooves 14B11, 14B2, a clear rhythm can be felt and a gentle contacting sound can be heard by the user of the switch.

FIG. 17 depicts an example of a rotating electric switch of the invention implemented in a pen. The rotating electric switch is used to operate a pen lamp (here, an LED 6) in the pen. An energy source in the pen (e.g., one or more stacked micro cells 8) powers the LED 6 when the rotating electric switch is in a conducting state.

In FIG. 17, the pen is shown having an upper pen casing 10 and a lower pen casing 2. An ink cartridge 3 inside an inner body 5 of the pen within the upper pen casing 10 delivers ink to a pen tip 1. A decorative band 4 may surround the pen at the junction of the upper pen casing 10 and the lower pen casing 2.

The inner body 5 holds the LED 6 which has one electrical connection pressed against the micro cells 8. The other electrical connection of the LED 6 is an electrical communication with threads 7 that are used to connect the upper pen casing 10 to the inner body 5. The threads 7 are electrically conductive with the upper pen casing 10 so that electrical energy traversing the upper pen casing 10 can pass through the threads 7 to the LED 6.

The upper pen casing 10 is further in electrical communication with the conductive sleeve 19 of the rotating electric switch. The pen may also include a clip 9 having a base imbedded in the pen that assists in electrically connecting the upper pen casing 10 to the conductive sleeve 19. The remaining assembled parts of the rotating electric switch in FIG. 17 are shown in FIGS. 1–16 with like reference numerals. The pen further includes a rotating cap 11 that is secured to the shaft 13 such that rotation of the cap 11 causes the shaft 13 to rotate within the electric switch. A low friction gasket 17 may be included between the rotating cap 11 and the upper pen casing 10 to facilitate the rotation of the cap 11.

When the shaft 13 is rotated and the bullets 16 line up with holes in the liner insulation cap 14, the bullets 16 electrically contact the conductive sleeve 19 and form a complete electrical circuit with the micro cells 8 and the LED 6. Further rotation of the shaft 13 causes the bullets 16 to retract within the liner insulation cap 14, thus breaking the electrical circuit. When the electrical circuit is closed (i.e., conducting), the LED 6 illuminates the pen. Likewise, when the electric switch is open (i.e., non-conducting), the LED 6 is not illuminated.

While a preferred embodiment of the rotating electric switch has been illustrated and described, along with alternative embodiments and an exemplary implementation of the switch in a pen, it will be appreciated that various changes can be made therein without departing from the spirit and scope of the invention. The scope of the invention should be determined from the following claims and equivalents thereto.

The embodiments of the invention in which an exclusive property or privilege is claimed are defined as follows:

1. A rotating electric switch, comprising:

a shaft formed of an insulating material having a sidewall and a bottom, the shaft having a side hole defined in the sidewall and a bottom hole defined in the bottom, wherein the side hole and the bottom hole are interlinked in the shaft;

a biasing member configured for insertion into the side hole of the shaft;

a bullet formed of an electrically-conductive material and having a base and a head, the base of the bullet being configured for insertion into the side hole of the shaft to bear against the biasing member, wherein the biasing member biases the bullet outward so that the head of the bullet is exposed outside of the shaft;

a shaft conductor formed of an electrically-conductive material and configured for insertion into the bottom hole of the shaft, wherein when inserted the shaft conductor is in electrical communication with the bullet;

a liner insulation cap formed of an insulating material and configured for placement over the shaft and the bullet such that the shaft can rotate within the liner insulation cap, the liner insulation cap having a sidewall with a hole extending through the sidewall; and an electrically conductive sleeve configured for placement over the hole in the liner insulation cap sidewall;

wherein the rotating electric switch is placed in a non-conducting state by rotating the shaft until the head of the bullet is retracted within the sidewall of the liner insulation cap; and wherein the rotating electric switch is placed in a conducting state by rotating the shaft until the bullet is positioned over the hole in the liner insulation cap sidewall, thereby permitting the head of the bullet to extend through the hole and electrically contact the conductive sleeve.

2. The rotating electric switch of claim 1, further comprising an inner tube configured for insertion into the side hole of the shaft, wherein the biasing member is configured for insertion into the inner tube when the inner tube is inserted in the shaft side hole of the shaft.

3. The rotating electric switch of claim 1, wherein the biasing member is a spring.

4. The rotating electric switch of claim 1, wherein the liner insulation cap further comprises a vertically-directed groove defined in the interior surface of the cap sidewall at a position rotationally offset from the hole in the cap sidewall, and when the bullet is positioned over the groove, the biasing member and groove cooperate to provide a detent force that retains the head of the bullet in the groove and holds the switch in a non-conducting state.

5. The rotating electric switch of claim 4, wherein the groove is configured of size and shape similar to the hole in the liner insulation cap sidewall.

6. The rotating electric switch of claim 1, wherein the biasing member and the hole in the cap sidewall cooperate to provide a detent force that retains the head of the bullet in the hole and holds the switch in a conducting state.

7. The rotating electric switch of claim 1, wherein multiple side holes are defined in the shaft sidewall, each side hole having a bullet that is biased outward by the biasing member so that the head of the bullet is exposed outside of the shaft.

8. The rotating electric switch of claim 7, wherein two side holes are defined in the shaft sidewall at positions symmetrically opposite to each other around the central axis of the shaft, each side hole having a bullet therein that is biased outward by the biasing member.

9. The rotating electric switch of claim 8, wherein the biasing member is a spring and the base of each bullet bears against an end of the spring.

10. The rotating electric switch of claim 1, wherein the liner insulation cap includes multiple holes extending through the cap sidewall, each hole configured to permit the head of a bullet to extend through and electrically contact the conductive sleeve when the bullet is positioned over a hole.

11. The rotating electric switch of claim 10, wherein two holes are defined in the liner insulation cap at positions symmetrically opposite to each other around the central axis of the liner insulation cap.

12. The rotating electric switch of claim 1, wherein the liner insulation cap includes multiple vertically-directed grooves defined in the interior surface of the cap sidewall at positions rotationally offset from the hole in the cap sidewall, and when the bullet is positioned over a groove, the biasing member and the groove cooperate to provide a detent force that retains the head of the bullet in the groove and holds the switch in a non-conducting state.

13. The rotating electric switch of claim 12, wherein two vertically-directed grooves are defined in the interior surface of the cap sidewall at positions symmetrically opposite to each other around the central axis of the liner insulation cap.

14. The rotating electric switch of claim 12, wherein the grooves are configured of size and shape similar to the hole in the liner insulation cap sidewall.

15. The rotating electric switch of claim 1, wherein the conductive sleeve is configured to surround the liner insulation cap.

16. The rotating electric switch of claim 1, wherein the shaft conductor is comprised of an electrically conductive post configured for insertion into the bottom hole of the shaft.

17. The rotating electric switch of claim 16, wherein the shaft conductor further comprises an electrically conductive spring inserted into the bottom hole of the shaft between the biasing member and the conductive post.

18. The rotating electric switch of claim 16, wherein an electric conductor in the form of a spring is further fitted onto the conductive post.

19. The rotating electric switch of claim 1, wherein the side hole and bottom hole are interlinked by the bottom hole extending into the side hole.

20. The rotating electric switch of claim 1, wherein the side hole and the bottom hole are interlinked by an electrical connection extending between the bottom hole and the side hole.

* * * * *